US011946669B1

(12) United States Patent
Ewbank et al.

(10) Patent No.: US 11,946,669 B1
(45) Date of Patent: Apr. 2, 2024

(54) POLYMODAL HEAT PUMP

(71) Applicants: Garen Noel Ewbank, Fairview, OK (US); Garry Alfred Sexton, Calico Rock, AR (US); Justin David Stonehocker, Coweta, OK (US); Bruce Duane Harman, Tulsa, OK (US)

(72) Inventors: Garen Noel Ewbank, Fairview, OK (US); Garry Alfred Sexton, Calico Rock, AR (US); Justin David Stonehocker, Coweta, OK (US); Bruce Duane Harman, Tulsa, OK (US)

( * ) Notice: Subject to any disclaimer, the term of this patent is extended or adjusted under 35 U.S.C. 154(b) by 0 days.

(21) Appl. No.: 17/955,232

(22) Filed: Sep. 28, 2022

Related U.S. Application Data

(60) Provisional application No. 63/249,209, filed on Sep. 28, 2021.

(51) Int. Cl.

| | |
|---|---|
| ***F24H 4/02*** | (2022.01) |
| ***F25B 13/00*** | (2006.01) |
| ***F25B 30/06*** | (2006.01) |
| ***F25B 41/31*** | (2021.01) |

(52) U.S. Cl.
CPC ..... *F24H 4/02* (2013.01); *F25B 13/00* (2013.01); *F25B 30/06* (2013.01); *F25B 41/31* (2021.01)

(58) Field of Classification Search
CPC ..... F25B 13/00; F25B 30/06; F25B 41/31; F25B 2313/002; F24D 2200/11; F24H 4/02
See application file for complete search history.

(56) References Cited

FOREIGN PATENT DOCUMENTS

| | | | | | |
|---|---|---|---|---|---|
| CN | 201000249 | Y | * | 1/2008 | |
| CN | 201155882 | Y | * | 11/2008 | |
| CN | 102080900 | B | * | 7/2015 | |
| CN | 206495696 | U | * | 9/2017 | |
| EP | 3798532 | A1 | * | 3/2021 | ..... F24F 5/0046 |
| JP | 2013249974 | A | * | 12/2013 | |
| JP | 2013249982 | A | * | 12/2013 | ..... F24J 3/086 |
| JP | 6883186 | B2 | * | 6/2021 | |
| KR | 20070011836 | A | * | 1/2007 | |
| KR | 20070111931 | A | * | 11/2007 | |
| WO | WO-2013172166 | A1 | * | 11/2013 | ..... F24D 3/18 |

* cited by examiner

*Primary Examiner* — Kun Kai Ma
(74) *Attorney, Agent, or Firm* — Plager Schack LLP; Mark H. Plager; Michael J. O'Brien

(57) ABSTRACT

A polymodal heat pump is configured heat domestic water and bidirectionally move heat between ambient air and beneath a ground surface. The polymodal heat pump has a compressor, with a compressor intake and a compressor discharge. A receiver and accumulator are joined to the compressor discharge is connected. A first reversing valve is joined to the receiver and accumulator and the compressor intake. A first coil is joined to the first reversing valve with a second motorized valve. A geothermal heat exchanger is joined to the first reversing valve with a third motorized valve. A second coil is joined to the first reversing valve with a fourth motorized valve. A first electronic expansion valve is joined to the second coil. A second electronic expansion valve is joined to the first coil through the first electronic expansion valve.

2 Claims, 7 Drawing Sheets

| VALVE DESIGNATIONS | | | | | | | | | | | |
|---|---|---|---|---|---|---|---|---|---|---|---|
| OPEN | O | OPEN IS NON-POWERED | | | | | | | | | |
| CLOSED | C | CLOSED IS POWERED | | | | | | | | | |
| METERING | M | | | | | | | | | | |
| VALVES | RV1 | MV1 | MV2 | MV3 | MV4 | EEV1 | EEV2 | EEV3 | OAH | AHU | PMP |
| ASH | O | C | O | C | O | O | M | C | C | C | O |
| ASC | C | C | O | C | O | M | O | C | C | C | O |
| WSH | O | C | C | O | O | O | C | M | O | C | C |
| WSC | C | C | C | O | O | M | C | O | O | C | C |
| GHEX+ | O | O | O | C | C | C | O | M | C | O | C |
| GHEX- | C | O | O | C | C | C | O | M | C | O | C |
| OAH | OUTDOOR AIR HANDLER | | | | | | | | | | |
| AHU | INDOOR AIR HANDLING UNIT | | | | | | | | | | |
| PMP | WATER LOOP/GROUND HEAT EXCHANGER CIRCULATION PUMP | | | | | | | | | | |

FIG.7

POLYMODAL HEAT PUMP

CLAIM OF BENEFIT TO PRIOR APPLICATION

This application claims benefit to United States Provisional Patent Application 63/249,209 entitled "Polymodal Heat Pump System The utility of a polymodal heat pump that provides indoor space conditioning, heats domestic water and bi-directionally moves heat between the outside air and an ambient temperature loop and or a ground heat exchanger using a refrigerant circuit," filed on Sep. 28, 2021. The U.S. Provisional Patent Application Ser. No. 63/249,209 is incorporated herein by reference.

BACKGROUND

The embodiments herein relate generally to heating, ventilation, and air-conditioning systems.

Prior to embodiments of the disclosed invention, air source and ground source heat pumps were separate and competing devices. Current ground source heat pumps were not scalable in the market due to the installation time required to complete the ground heat exchanger.

Air source heat pumps performed poorly at peak blocks loads when heating or cooling and added demand on the electrical power system. Ground or water source systems, while reducing electrical demand, were not easily installed due to the need to install the ground heat exchanger or a cooling tower and a boiler. Embodiments of the disclosed invention solve these problems

SUMMARY

A polymodal heat pump is configured heat domestic water and bidirectionally move heat between ambient air and beneath a ground surface. The polymodal heat pump has a compressor, with a compressor intake and a compressor discharge. A receiver and accumulator are joined to the compressor discharge is connected. A first reversing valve is joined to the receiver and accumulator and the compressor intake. A first coil is joined to the first reversing valve with a second motorized valve. A geothermal heat exchanger is joined to the first reversing valve with a third motorized valve. A second coil is joined to the first reversing valve with a fourth motorized valve. A first electronic expansion valve is joined to the second coil. A second electronic expansion valve is joined to the first coil through the first electronic expansion valve.

A third electronic expansion valve is connected to a line between the first electronic expansion valve and the second electronic expansion valve. The first coil is part of an outdoor air handling unit, and the second coil is part of an indoor air handling unit; in order to transfer heat between the first coil, the second coil and a ground water source proximate the geothermal heat exchanger.

BRIEF DESCRIPTION OF THE FIGURES

The detailed description of some embodiments of the invention is made below with reference to the accompanying figures, wherein like numerals represent corresponding parts of the figures.

FIG. 7 shows block diagram of one embodiment of the present invention showing valve positions.

DETAILED DESCRIPTION OF CERTAIN EMBODIMENTS

By way of example, and referring to FIGS. 1-6, a compressor has a compressor intake and a compressor discharge. The compressor discharge is connected to a receiver and accumulator. The receiver and accumulator are mechanically coupled to a first reversing valve RV-1. The first reversing valve RV-1 is joined to the compressor intake. The first reversing valve RV-1 is further joined a first coil with a second motorized valve MV-2, and a geothermal heat exchanger with a third motorized valve MV-3. The first reversing valve RV-1 is further joined to the geothermal heat exchanger with a first motorized valve MV-1, and a second coil with a fourth motorized valve RV-4. The geothermal heat exchanger is joined to a ground heat exchanger circulation pump.

The second coil is joined to a first electronic expansion valve EEV1. The first electronic expansion valve EEV1 is joined to the first coil a second electronic expansion valve EEV2. The first coil is part of an outdoor air handling unit, and the second coil is part of an indoor air handling unit. The ground heat exchanger is connected to a line between the first electronic expansion valve EEV1 and the second electronic expansion valve EEV2 with a third electronic expansion valve EEV3.

Figure 1:
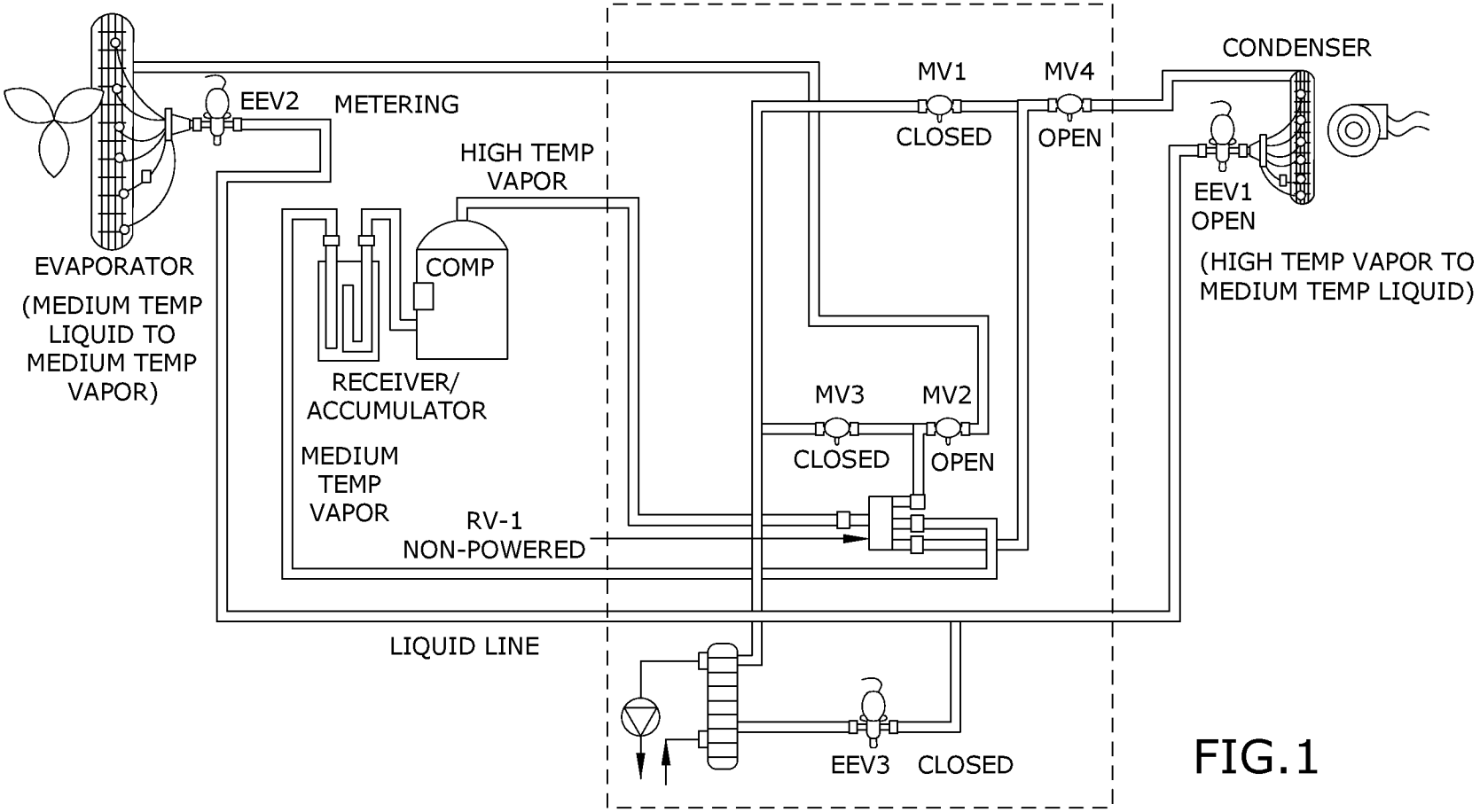
FIG. 1 shows a schematic view of one embodiment of the present invention providing air source heating.

Referring to FIG. 1, the polymodal heat pump is arranged in a first mode of operation providing air source heating. The first reversing valve RV-1 is open. The first motorized valve MV-1 is closed. The second motorized valve MV-2 is open. The third motorized valve MV-3 is closed. The fourth motorized valve MV-4 is open. The first electronic expansion valve EEV1 is open. The second electronic expansion valve EEV2 is metering. The third electronic expansion valve EEV3 is closed. The outdoor air handler is powered. The indoor air handler is powered. The ground heat exchanger circulation pump is off.

Figure 2:
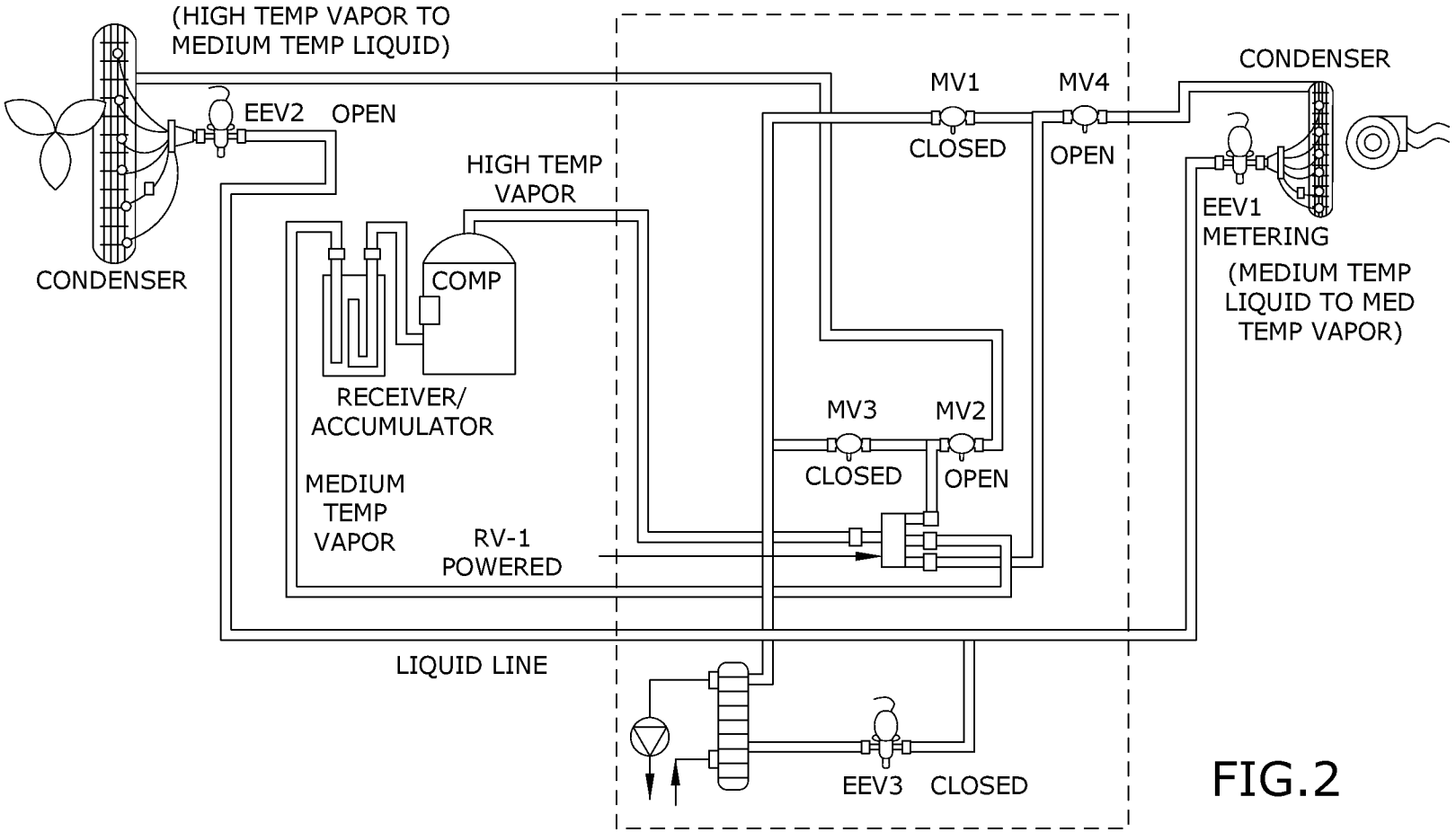
FIG. 2 shows a schematic view of one embodiment of the present invention providing air source cooling.

Referring to FIG. 2, the polymodal heat pump is arranged in a second mode of operation providing air source cooling. The first reversing valve RV-1 is closed. The first motorized valve MV-1 is closed. The second motorized valve MV-2 is open. The third motorized valve MV-3 is closed. The fourth motorized valve MV-4 is open. The first electronic expansion valve EEV1 is metering. The second electronic expansion valve EEV2 is open. The third electronic expansion valve EEV3 is closed. The outdoor air handler is powered. The indoor air handler is powered. The ground heat exchanger circulation pump is off.

Figure 3:
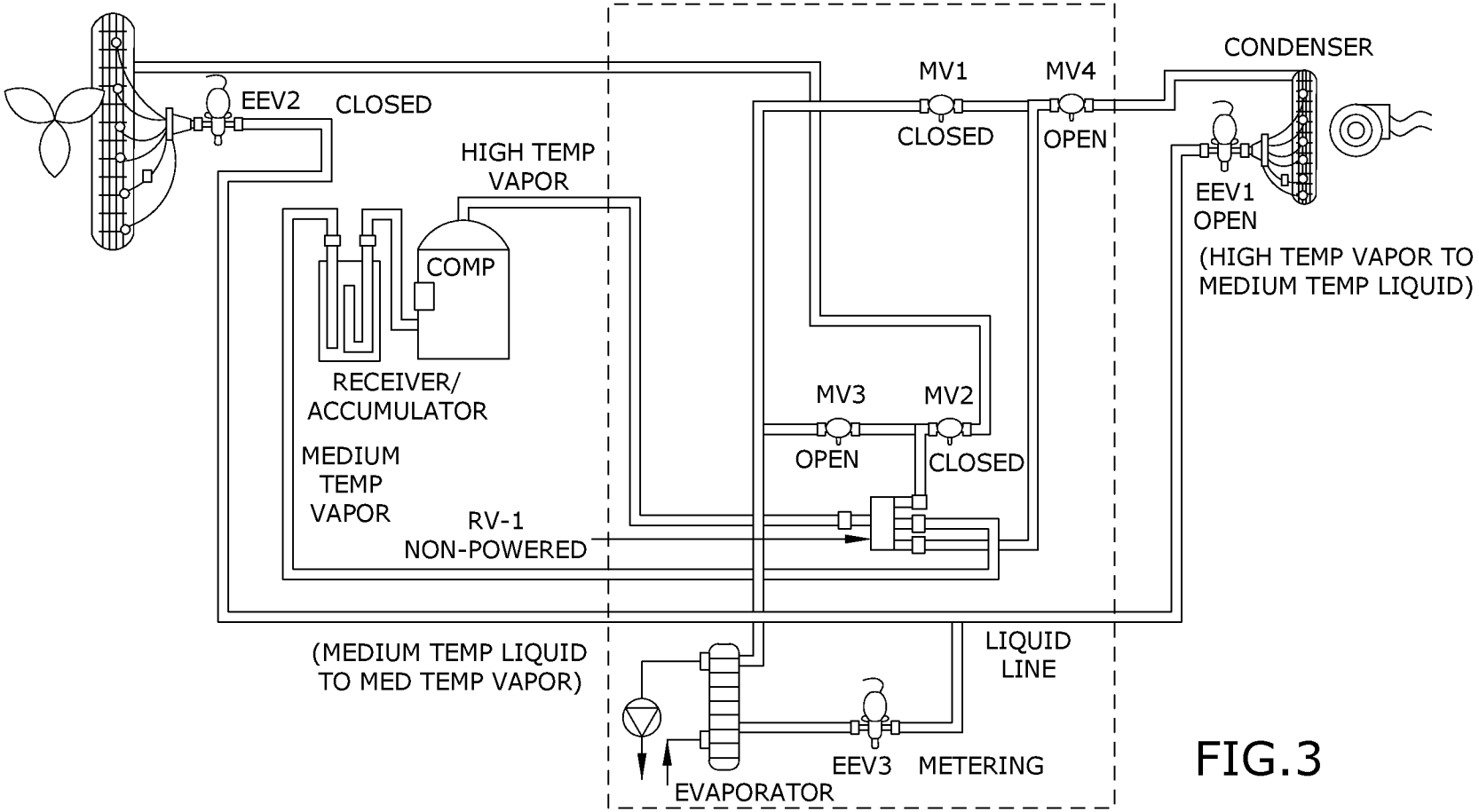
FIG. 3 shows a schematic view of one embodiment of the present invention providing water source heating.

Referring to FIG. 3, the polymodal heat pump is arranged in a third mode of operation providing water source heating. The first reversing valve RV-1 is open. The first motorized valve MV-1 is closed. The second motorized valve MV-2 is closed. The third motorized valve MV-3 is open. The fourth motorized valve MV-4 is open. The first electronic expansion valve EEV1 is open. The second electronic expansion valve EEV2 is closed. The third electronic expansion valve EEV3 is metering. The outdoor air handler is unpowered. The indoor air handler is powered. The ground heat exchanger circulation pump is on.

Figure 4:
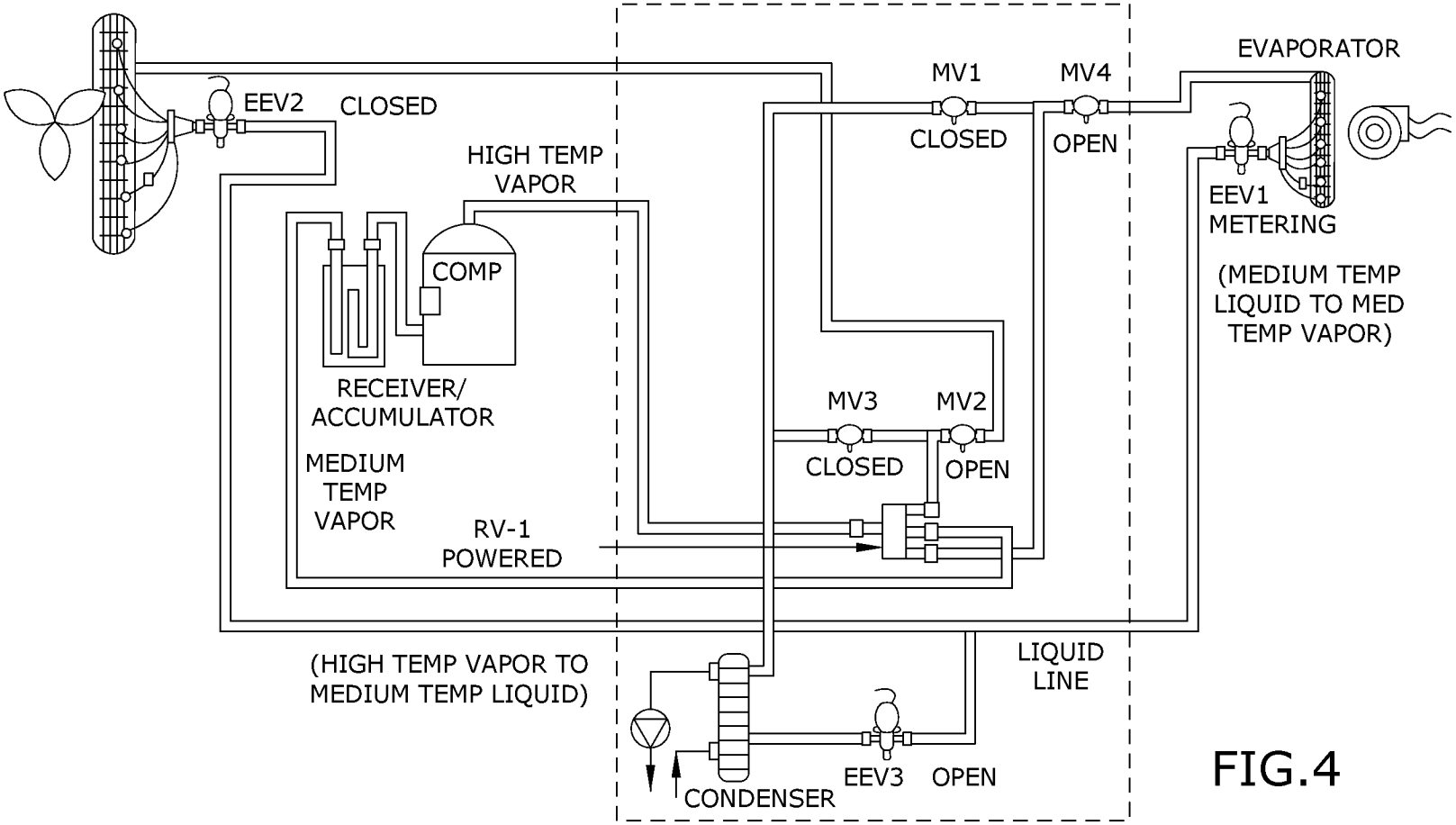
FIG. 4 shows a schematic view of one embodiment of the present invention providing water source cooling.

Referring to FIG. 4, the polymodal heat pump is arranged in a fourth mode of operation providing water source cooling. The first reversing valve RV-1 is closed. The first motorized valve MV-1 is closed. The second motorized valve MV-2 is closed. The third motorized valve MV-3 is open. The fourth motorized valve MV-4 is open. The first electronic expansion valve EEV1 is metering. The second electronic expansion valve EEV2 is closed. The third electronic expansion valve EEV3 is open. The outdoor air handler is unpowered. The indoor air handler is powered. The ground heat exchanger circulation pump is on.

Figure 5:
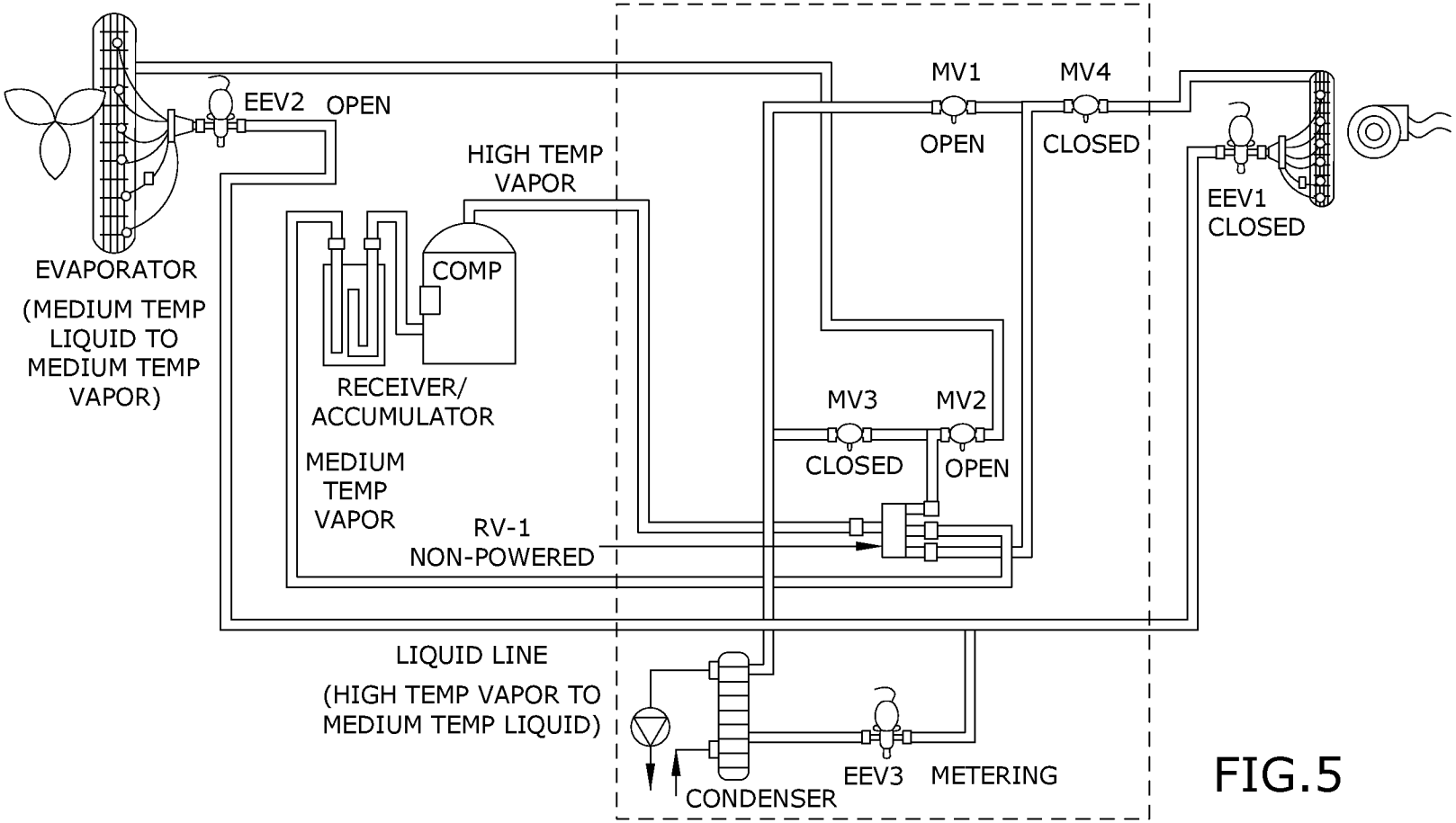
FIG. 5 shows a schematic view of one embodiment of the present invention providing heat to a ground heat exchanger.

Referring to FIG. 5, the polymodal heat pump is arranged in a fifth mode of operation providing ground water heating. The first reversing valve RV-1 is open. The first motorized valve MV-1 is open. The second motorized valve MV-2 is open. The third motorized valve MV-3 is closed. The fourth motorized valve MV-4 is closed. The first electronic expansion valve EEV1 is closed. The second electronic expansion valve EEV2 is open. The third electronic expansion valve EEV3 is metering. The outdoor air handler is powered. The indoor air handler is unpowered. The ground heat exchanger circulation pump is on.

Figure 6:
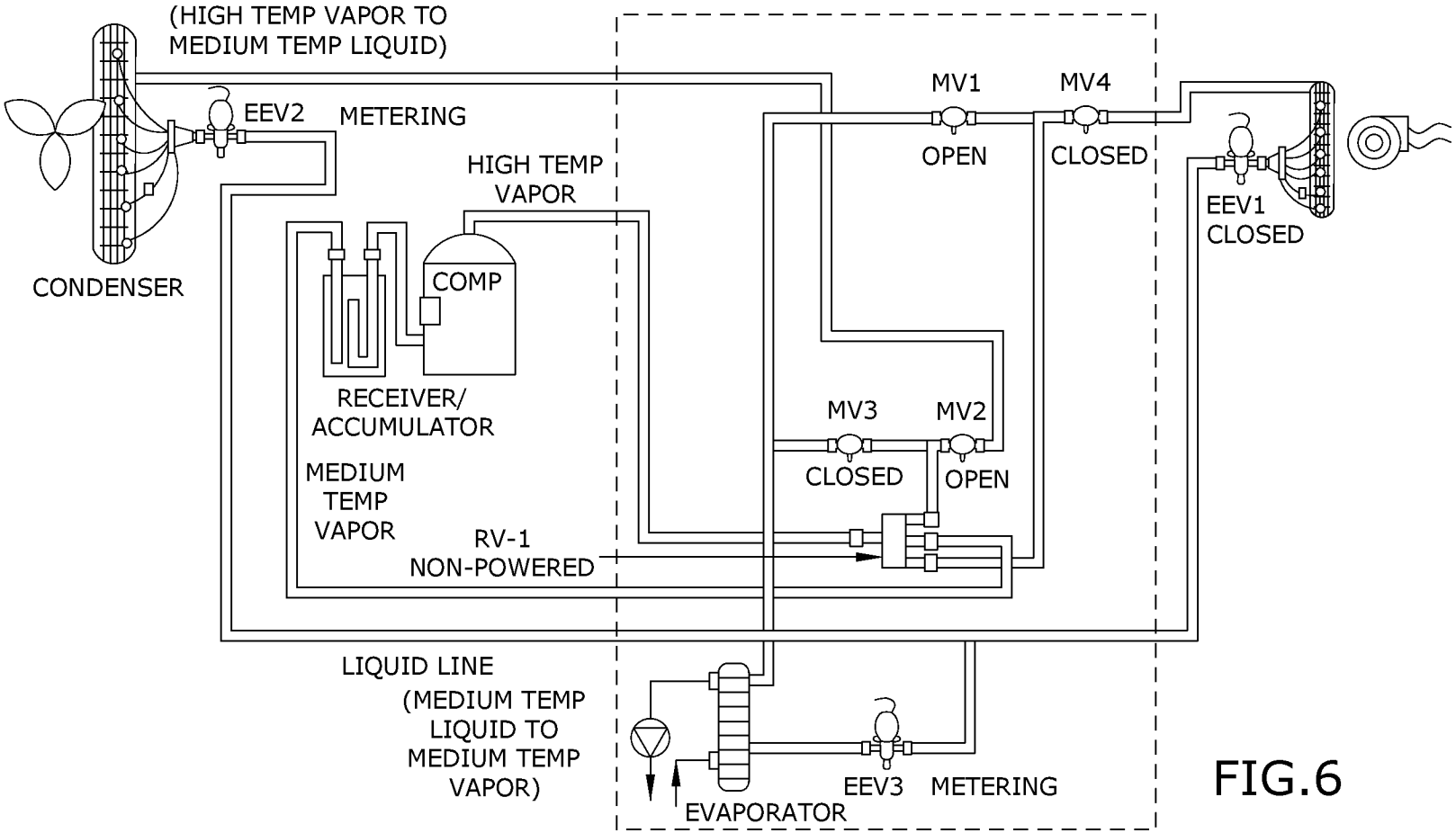
FIG. 6 shows a schematic view of one embodiment of the present invention removing heat to a ground heat exchanger.

Referring to FIG. 6, the polymodal heat pump is arranged in a sixth mode of operation providing ground water cooling. The first reversing valve RV-1 is closed. The first motorized valve MV-1 is open. The second motorized valve MV-2 is open. The third motorized valve MV-3 is closed. The fourth motorized valve MV-4 is closed. The first electronic expansion valve EEV1 is closed. The second electronic expansion valve EEV2 is open. The third electronic expansion valve EEV3 is metering. The outdoor air handler is powered. The indoor air handler is unpowered. The ground heat exchanger circulation pump is on.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 116. In particular, any use of "step of" in the claims is not intended to invoke the provision of 35 U.S.C. § 112, 116.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A polymodal heat pump, configured to heat domestic water and bidirectionally move heat between ambient air and beneath a ground surface; the polymodal heat pump comprising:

a compressor, further comprising a compressor intake and a compressor discharge;

a receiver or an accumulator, joined to the compressor discharge is connected;

a first reversing valve, joined to the receiver or the accumulator and the compressor intake;

a first coil, joined to the first reversing valve with a second motorized valve, a geothermal heat exchanger, joined to the first reversing valve with a third motorized valve;

a second coil, joined to the first reversing valve with a fourth motorized valve;

a first electronic expansion valve, joined to the second coil;

a second electronic expansion valve, joined to the first coil through the first electronic expansion valve;

a third electronic expansion valve, connected to a line between the first electronic expansion valve and the second electronic expansion valve;

wherein the first coil is part of an outdoor air handling unit, and the second coil is part of an indoor air handling unit; in order to transfer heat between the first coil, the second coil and a ground water source proximate the geothermal heat exchanger.

2. The polymodal heat pump of claim 1, further comprising a ground heat exchanger circulation pump joined to the geothermal heat exchanger.

* * * * *